United States Patent [19]

Hennemann et al.

[11] 4,153,570

[45] May 8, 1979

[54] LOW-FOAMING LIQUID WASHING AGENT CONCENTRATES

[75] Inventors: Manfred Hennemann, Düsseldorf-Benrath; Albrecht Löhr, Ratingen-Eggerscheid; Peter Krings, Krefeld, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 873,510

[22] Filed: Jan. 30, 1978

[30] Foreign Application Priority Data

Feb. 1, 1977 [DE] Fed. Rep. of Germany ..... 2703998

[51] Int. Cl.[2] ..... C11D 9/32

[52] U.S. Cl. ..... 252/121; 252/89 R; 252/106; 252/117; 252/534; 252/554

[58] Field of Search ..... 252/121, 117, 534, 554, 252/106, 89

[56] References Cited

U.S. PATENT DOCUMENTS

| | | | |
|---|---|---|---|
| 3,714,074 | 1/1973 | Inamorato | 252/117 |
| 3,943,178 | 3/1976 | Stein et al. | 252/121 |
| 4,058,473 | 11/1977 | Canter | 252/121 |

*Primary Examiner*—Mayer Weinblatt
*Attorney, Agent, or Firm*—Hammond & Littell

[57] ABSTRACT

Low foaming, liquid, aqueous washing agent concentrate comprising (a) 5 to 12 weight % of a linear sodium alkyl benzene sulfonate with 10–13 carbon atoms in the alkyl chain and/or of a linear secondary sodium alkane sulfonate with 14–18 carbon atoms:

(b) 2 to 6 weight % of a linear sodium alkyl polyglycol ether sulfate with 10–16 carbon atoms in the alkyl chain and 1–3 ethylene glycol ether groups;

(c) 2 to 6 weight % of a sodium or potassium soap of mainly saturated fatty acids with 12–18 carbon atoms, 50–90 weight % of which have 16–18 carbon atoms;

(d) 15 to 28 weight % of a mixture of ethoxylated alcohols, consisting of (i) 30–50 weight % of linear primary ethoxylated alcohols with 16–18 carbon atoms and 8–12 glycol ether groups and (ii) 30–50 weight % of linear primary ethoxylated alcohols with 16–18 carbon atoms and 3–7 glycol ether groups, both of said ethoxylated alcohols having a ratio of saturated to mono-unsaturated hydrocarbon residues of 1:4 to 4:1, and (iii) 10–30 weight % of linear and/or 2-methyl substituted primary saturated ethoxylated alcohols with 10–15 carbon atoms and 4–9 glycol ether groups;

(e) 2 to 7 weight % of a fatty acid diethanolamide with 10–16 carbon atoms in the fatty acid residue;

(f) 4 to 10 weight % of a toluene, xylene or isopropylbenzene sulfonate in the form of the sodium, potassium or triethanolamine salt; and (g) 2 to 7 weight % of an alkanol with 1–3 carbon atoms;

and the remainder water and optionally other conventional ingredients, wherein the total weight of all the anhydrous components of said concentrate amounts to between 40 and 65 weight % thereof.

21 Claims, No Drawings

LOW-FOAMING LIQUID WASHING AGENT CONCENTRATES

BACKGROUND OF THE INVENTION

Liquid washing agent compositions that are to be used in washing machines must have a low rate of foaming since excess foaming must be expected with a washing agent composition concentration above 3 to 5 gm per liter. Furthermore, such washing agent compositions are expected to prevent the deposits on heating elements and the wash that are caused by hard water. The latter requirement generally calls for the use of relatively large amounts of condensed phosphates, i.e., complexing agents, an addition that is no longer acceptable for ecological reasons. It was found that only tripolyphosphate, which is relatively difficult to include in liquid concentrates, can effectively prevent the formation of deposits, whereas the pyrophosphate, which is generally used in liquid washing agent compositions because of its better solubility, either does not at all prevent the formation of such deposits or only prevents them to an inadequate degree. When phosphate is not used, the content of tensides with washing action must be considerably increased to obtain a satisfactory washing result. However, a relatively high tenside concentration generally increases the rate of foaming so that the agents are no longer low-foaming in new, automatic washers.

Among the additional properties expected of a liquid washing agent composition by the expert is a water content which is as low as possible to keep the packaging weight down. However, the concentration of active substance cannot be increased at will, since compositions with a content of active substance exceeding 40 weight % tend to separate into phases that frequently become irreversible on cooling of the compositions to temperatures close to the freezing point. Another frequently observed disadvantage of many concentrated liquid washing agent compositions is the fact that the solutions gel, especially upon the addition of water, and can then no longer be uniformly distributed in the wash liquor. These problems can be corrected by the addition of sizable amounts of organic solvents, especially lower alcohols in proportions of more than 8%, but their addition introduces technical problems during the production and utilization of the liquid washing agent composition because of the increased danger of fire or explosions. Even the use of triethanolamine salts, which are readily soluble in water, or the addition of free triethanolamine as solubilizer, does not solve the problem in many cases since triethanolamine salts are more expensive than the sodium salts and triethanolamine, when present in sizable amounts, considerably reduces the effect of bleaches, especially active chlorine or peracids, due to the consumption of chlorine or oxygen.

OBJECTS OF THE INVENTION

An object of the present invention is the development of a liquid washing agent concentrate which has a strong cleaning power and prevents deposits on the heating elements of washing machines and on the wash but which does not have the tendency to form excessive foam.

Another object of the present invention is the development of a liquid washing agent concentrate which has an unlimited shelf-life, even at low temperatures, does not have any tendency to gel, and does not interfere with the activity of strong bleaching agents.

A further object of the present invention is the development of a liquid washing agent concentrate which does not attack the skin, leaves the washed articles pleasant to touch and is largely unobjectionable from the ecological standpoint.

A yet further object of the present invention is the development of a low-foaming, liquid, aqueous washing agent concentrate comprising (a) 5 to 12 weight % of a linear sodium alkyl benzene sulfonate with 10–13 carbon atoms in the alkyl chain and/or of a linear secondary sodium alkane sulfonate with 14–18 carbon atoms;

(b) 2 to 6 weight % of a linear sodium alkyl polyglycol ether sulfate with 10–16 carbon atoms in the alkyl chain and 1–3 ethylene glycol ether groups;

(c) 2 to 6 weight % of a sodium or potassium soap of mainly saturated fatty acids with 12–18 carbon atoms, 50–90 weight % of which have 16–18 carbon atoms;

(d) 15 to 28 weight % of a mixture of ethoxylated alcohols, consisting of (i) 30–50 weight % of linear primary ethoxylated alcohols whith 16–18 carbon atoms and 8–12 glycol ether groups and (ii) 30–50 weight % of linear primary ethoxylated alcohols with 16–18 carbon atoms and 3–7 glycol ether groups, both of said ethoxylated alcohols having a ratio of saturated to monounsaturated hydrocarbon residues of 1:4 to 4:1, and (iii) 10–30 weight % of linear and/or 2-methyl substituted primary saturated ethoxylated alcohols with 10–15 carbon atoms and 4–9 glycol ether groups;

(e) 2 to 7 weight % of a fatty acid diethanolamide with 10–16 carbon atoms in the fatty acid residue;

(f) 4 to 10 weight % of a toluene, xylene or isopropylbenzene sulfonate in the form of the sodium, potassium or triethanolamine salt: and (g) 2 to 7 weight % of an alkanol with 1–3 carbon atoms; and the remainder water and optionally other conventional ingredients, wherein the total weight of all the anhydrous components of said concentrate amounts to between 40 and 65 weight % thereof.

These and other object of the present invention will become more apparent as the description thereof proceeds.

DESCRIPTION OF THE INVENTION

The above objects have been achieved and the drawbacks of the prior art have been overcome by the present invention which provides a low-foaming, liquid, aqueous washing agent concentrate characterized by a content of:

(a) a sodium alkyl benzene sulfonate and/or a secondary sodium alkane sulfonate;

(b) a sodium alkylpolyglcol ether sulfate;

(c) a potassium or sodium soap consisting of mainly saturated fatty acids;

(d) a mixture of ethoxylated alcohols;

(e) a fatty acid diethanolamide;

(f) a toluene, xylene or isopropylbenzene sulfonate in the form of the sodium, potassium or triethanolamine salt; and (g) a lower alkanol; and the remainder of said concentrate being water and optionally other conventional ingredients; with the proviso that the total weight of all the anhydrous components of said concentrate amounts to between 40 and 65 weight % of said concentrate.

More particularly, the present invention provides a low-foaming, liquid, aqueous washing agent concentrate comprising (a) from 5% to 12% by weight of a member selected from the group consisting of a linear sodium alkyl benzene sulfonate having from 10 to 13 carbon atoms in the alkyl chain, a linear secondary sodium alkane sulfonate having from 14 to 18 carbon atoms, and a mixture thereof;

(b) from 2% to 6% by weight of a linear sodium alkylpolyglycol ether sulfate having from 10 to 16 carbon atoms in the alkyl chain and from 1 to 3 ethylene glycol ether groups;

(c) from 2% to 6% by weight of a potassium or sodium soap composed of mainly saturated fatty acids having from 12 to 18 carbon atoms, of which 50% to 90% by weight have from 16 to 18 carbon atoms;

(d) from 15% to 28% by weight of a mixture of ethoxylated alcohols composed of (i) from 30% to 50% by weight of linear primary ethoxylated alcohols having from 16 to 18 carbon atoms and 8 to 12 glycol ether groups and (ii) from 30% to 50% by weight of linear primary ethoxylated alcohols having from 16 to 18 carbon atoms and 3 to 7 glycol ether groups, both types of said ethoxylated alcohols having a ratio of saturated to mono-unsaturated hydrocarbon residues of from 1:4 to 4:1, and (iii) from 10% to 30% by weight of primary saturated ethoxylated alcohols, which are linear or have a methyl group in the 2-position or are a mixture of said linear and 2-methyl substituted ethoxylated alcohols, and have from 10–15 carbon atoms and from 4 to 9 glycol ether groups.

(e) from 2% to 7% by weight of a fatty acid diethanolamide having from 10 to 16 carbon atoms in the fatty acid residue;

(f) from 4% to 10% by weight of a member selected from the group consisting of toluene sulfonate, xylene sulfonate and isopropylbenzene sulfonate in the form of the sodium, potassium or triethanolamine salt; and (g) from 2% to 7% by weight of an alkanol having from 1 to 3 carbon atoms;

and the remainder of said concentrate being water and optionally other conventional ingredients; with the proviso that the total of all anhydrous components of said concentrate is from 40% to 65% by weight of said concentrate.

The component described under (a) above consists of n-alkyl benzene sulfonates having from 10 to 13 carbon atoms in the linear alkyl radical or of linear alkane sulfonates derived from straight-chain $C_{14-18}$-alkanes and having 1 or 2 sulfonate groups that are not terminally located. Such alkane sulfonates can be obtained from n-alkanes by sulfochlorination or sulfoxidation in a well-known manner. In addition to the individual components, mixtures of n-alkyl benzene sulfonates and alkane sulfonates are suitable as well. Component (a) of the washing agent concentrates of the invention consists preferably of from 6% to 10% by weight of sodium n-dodecyl-benzene sulfonate.

The above described component (b) of the washing agent concentrates of the invention is derived from normal alcohols having from 10 to 16 carbon atoms; i.e. those that can be obtained from synthetic or natural raw materials, e.g. fatty acids of coconut oil. The average number of ethylene glycol ether groups is preferably 2, the number of carbon atoms in the alkyl radical is preferably from 12 to 14 and the content of the sodium salt of ether sulfate in the washing agent concentrate of the invention is preferably from 3% to 5% by weight.

The above-described component (c) of the washing agent concentrates of the invention consists preferably of a sodium soap of mainly saturated fatty acids, i.e. those with a content of polyunsaturated fatty acids below 0.1 weight % and a content of monounsaturated fatty acids below 10 weight %. Furthermore, the content of $C_{16-18}$-fatty acids is from 50% to 90% by weight of the mostly saturated fatty acids. Suitable fatty acid mixtures are obtained, for example, by combining coconut oil fatty acids and tallow fatty acids or hardened fatty acids mixtures of an analogous composition to the tallow fatty acids. Said suitable fatty acid mixtures have a ratio of 1:4 to 1:20 of $C_{12-14}$-fatty acids to $C_{16-18}$-fatty acids. The content of the sodium soaps is preferably from 3% to 5% by weight of the washing agent concentrate.

The above-described component (d) of the washing agent concentrates of the invention consists of 3 components differing partly in the structure of the hydrocarbon radical and partly in the degree of ethoxylation. The two first-mentioned components of component (d) contain linear primary alcohol radicals having from 16 to 18 carbon atoms, obtainable, for example, in known manner from natural fatty acids, particularly from tallow fatty acids. Such mixtures contain, e.g. cetyl, stearyl, palmitoyl, and oleyl alcohols in addition to which, depending on the production, small amounts of alcohols with less than 16 and more than 18 carbon atoms may occur. The ratio of saturated to mono-unsaturated hydrocarbon radicals is 4:1 to 1:4, preferably 2:1 to 1:2. From these fatty alcohols are derived a nonionic component with an average of 8 to 12, preferably 9 to 11, glycol ether groups and a second nonionic component with an average of 3 to 7, preferably 4 to 6, glycol ether groups. The term "average" means that the maximum of the statistical chain distribution curve for the added glycol ether groups lies in the given range. These two ethoxylated alcohol components are present in component (d) preferably in an amount of 35% to 45% by weight each.

The third component contained in component (d) of the washing agent concentrates of the invention consists of an ethoxylated alcohol that contains from 10 to 15 carbon atoms and has a straight chain or has a chain with a methyl group in a side chain at the 2-position thereof, or consists of mixtures of ethoxylated alcohols having hydrocarbon radicals with straight chains and branched chains having methyl groups in the side-chains. Alcohols with a methyl group in the 2-position as well as their mixtures with straight-chain alcohols are obtainable in a well-known manner by oxosynthesis. Instead of the oxoalcohols or in mixture with these there can also be used alcohols obtainable from natural fatty acids, especially coconut oil fatty acids, as starting materials. The ethoxylated alcohols constituting the third component of component (d) contain preferably from 12 to 15 carbon atoms and 5 to 7 glycol ether groups. The proportion of these nonionic components is preferably from 15% to 25% by weight of component (d) of the washing agent concentrates of the invention.

Component (d) constitutes preferably from 16% to 25% by weight of the washing agent concentrate of the invention.

The washing agent concentrates according to the invention contain as further components the diethanolamides of fatty acids of component (e), which can also be derived from natural or synthetic fatty acids, especially from coconut oil fatty acids, and contain preferably from 12 to 14 carbon atoms in the acyl radical. The content of such diethanolamides of fatty acids in the washing agent concentrates according to the invention is preferably from 3% to 6% by weight.

The washing agent concentrates according to the invention also contain the hydrotropic substances described under (f) above to improve the solubility, such as toluene, xylene, or isopropylbenzene sulfonate in the form of the sodium or potassium salt in amounts of from 4% to 10% by weight, but especially potassium toluene sulfonate, in amounts of from 5% to 8% by weight. $C_{1-3}$-alkanols such as ethanol, propanol, isopropanol and their mixtures are present as additional solubilizers in amounts of from 2% to 7% by weight, preferably ethanol, in amounts of from 3% to 6% by weight. These relatively small amounts of organic solvent do not cause any problems with respect to combustibility and also do not interfere with any perfume possibly present, which will be appreciated by numerous consumers.

Complexing agents, e.g. the sodium, potassium or triethanolamine salts of aminopolycarboxylic acids or aminopolyphosphonic acids can be present in the washing agent concentrates as optional components to mask heavy metal ions. Examples of such complexing agents are nitrilotriacetate (NTA), ethylenediaminetetraascetate (EDTA), diethylenetriaminepentaacetate, aminotri-(methylene phosphonate), ethylenediaminetetra-(methylene phosphonate), aminotri(ethylidene phosphonate) and their homologs. Mixtures of complexing agents are also suitable. The content of the compounds used according to the invention as complexing agents is suitably from 0.1% to 2% by weight. EDTA in the form of the sodium salt is used preferably in amounts of from 0.2% to 1% by weight.

Other useful additives are water-soluble optical brighteners, e.g. triazinyl stilbene derivatives of the formula

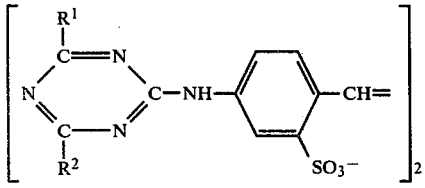

wherein $R^1$ is anilino and $R^2$, for example, is a member selected from the group consisting of anilino, morpholino, methylamino, ethanolamino, diethanolamino or N-methyl ethanolamino groups. Particularly suitable are diphenyldistyryl compounds that are resistant to oxidizing agents and are of the following formula

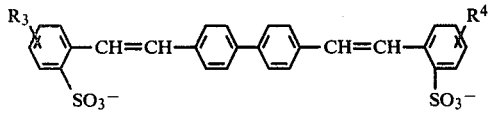

wherein $R^3$ and $R^4$ H, F, $CF_3$, Cl, $C_nH_{(2n+1)}$, $O—C_nH_{(2n+1)}$, COOH, $COOC_nH_{(2n+1)}$, —CN and $SO_2NH_2$, and n is a number from 1 to 4. Mixtures of several optical brighteners can be used as well. Their proportion in the washing agent concentrates of the invention can amount to from 0.001% to 0.5% by weight.

The washing agent concentrates of the invention can also contain preservatives, as well as dyes and perfumes, or additives that impart a pearly luster, e.g. the distearic acid ester of ethylene or diethylene glycol. The amount of these substances is generally up to 1% by weight, depending upon their effectiveness.

The total content of anhydrous materials in the washing agent concentrates according to the invention, i.e. components (a) to (g), and including any optionally added complexing agent, optical brighteners, preservatives and finishing agents, is 40% to 65% by weight. The remainder is water.

Additional supporting substances, especially phosphates and salts of polymer carboxylic acids, are not contained in the washing agent concentrates of the invention since they would reduce the solubility of the concentrates or could lead to ecological objections. Similarly, the content of free alkanolamines or of those alkanolamines forming salt-like substances, especially triethanolamine, is kept below 3 weight %, preferably below 1 weight % of the washing agent concentrates for the previously mentioned reasons.

The washing agent concentrates of the invention are characterized by a strong cleaning power when used for texiles of natural and synthetic fibers, such as wool, silk, rayon, polyester and polyamide fibers, and also for those of cellulose or processed cotton. In this respect, they are superior to similar products available on the market. It is highly surprising that the washing agent concentrates of the invention do not have the tendency to form excessive foam, even when they are used in concentrations of, e.g., 10 gm per liter in drum washing machines, despite their relatively high content of high foaming tensides, mainly of alkyl benzene sulfonate and alkyl polyglycol ether sulfate, as well as their content of the ethanolamide of fatty acids, which is known to intensify foaming. Furthermore, despite their content of soaps, they do not have the tendency to precipitate calcium soaps and incrustations on the textiles being washed or on the heating elements of washing machines, even when they are used in very hard water.

The washing agent concentrates provide clear solutions that have an unlimited shelf-life and do not separate at temperatures of 0° C. to 30° C. Even the fact that the washing agent compositions form clear, concentrated solutions of great stability, despite the preponderant use of sodium salts instead of the more easily soluble potassium or triethanolamine salts used almost exclusively in liquid concentrates, must be considered highly surprising. The concentrates do not have any tendency to gel; they are easy to pour and handle and distribute themselves quickly and completely in the wash water.

The washing agent concentrates of the invention possess excellent stability against active chlorine or per-acid compounds and do not interfere with their bleaching effect since the concentrates contain very little or no triethanolamine salts. Thus the concentrates can be combined without any problems with strong bleaches such as hypochlorite or per-acids, i.e. even such per-acids formed as intermediates from per-salts and bleach activators. Because of their content of ethanolamides of fatty acids they do not attack the skin and the washed textiles become pleasant to touch. Since the concentrates contain tensides with a good biodegradability but no phosphates and since the amount of optionally included complexing agents is very low, they may be considered largely unobjectionable from the ecological point of view.

The concentration of the washing agent concentrates in the ready-to-use wash solutions is generally between 2 and 10 gm per liter, especially between 3 and 6 gm per liter. In this dilution, the wash solutions generally have a pH of 7.2 to 10.0.

The present invention will now be further illustrated by way of the following examples and comparative experiments, without, however, it being limited thereto.

EXAMPLES

The examples describe compositions of some preparations according to the invention. The amounts of the components in the preparations are presented in the following Table I. The nature of the components used in the preparations of Table I was as follows:

The n-alkane sulfonate had an average chain length of 16 carbon atoms.

The diglycol ether sulfate was prepared from coconut fatty alcohols and had an average chain length of 12.7 carbon atoms.

The soap was made of a fatty acid mixture of 10 weight % coconut oil soap and 90 weight % tallow fatty acid soap with a content of less than 1 weight % unsaturated fatty acids.

The $C_{16-18}$-alcohol, based on which the first two nonionic tensides listed in Table I were prepared, had an iodine number of 50 and consisted of 53 weight % oleyl alcohol, 27 weight % stearyl alcohol and 20 weight % cetyl alcohol.

The oxoalcohol, based on which the third nonionic tenside listed in Table I was prepared, consisted of 76 weight % straight-chain alcohols and 24 weight % alcohols with a 2-methyl substituent.

The abbreviation "EO" represents an added ethylene oxide unit. For the first two nonionic tensides of Table I, 10 and 5 moles, respectively, of ethylene oxide (EO) were adducted to 1 mole of the $C_{16-18}$ alcohol mixture. For the third nonionic tenside, 7 moles of EO were adducted to 1 mole of the $C_{14-15}$ oxoalcohol mixture.

The "$C_{12-14}$-alcohol+6 EO" component of Table I represents the addition product of 6 moles of ethylene oxide (EO) adducted to 1 mole of a $C_{12-14}$-alcohol which was obtained from fatty acids of coconut oil and had a mean chain length of 12.7.

The "$C_{12-14}$-fatty acid diethanolamide" component of Table I was prepared from fatty acids of coconut oil and had a mean chain length of 12.7.

The optical brightener used in Example 2 of Table I was a triazinyl stilbene disulfonic acid derivative according to the formula on page 12 of the specification in which $R^1$ is an anilino radical and $R^2$ a morpholino radical. A diphenyldistyryl brightener according to the formula on page 12 of the specification was used in Example 3 of Table I, in which $R^3$ and $R^4$ are hydrogen. Both brighteners were used in the form of sodium salts.

The formalin acted as preservative.

The pH of the products presented in Table I was between 10.8 (Example 1) and 11.3 (Example 5). It was between 9.6 (Example 1) and 10 (Example 5), when the products were used in a concentration of 10 gm/liter in softened water; between 7.4 (Example 1) and 7.6 (Example 5), when the products were used in a concentration of 4 gm/liter in tap water of a hardness of 16° dH. The viscosity of the products at 20° C. (measured with Brookfield spindle #2 at 20 rpm) was between 300 cP (Example 1) and 600 cP (Example 5).

All percents in Table I are percent by weight.

TABLE I

| Component of Preparation | % By Weight According to Example 1 | 2 | 3 | 4 | 5 |
|---|---|---|---|---|---|
| n-Dodecylbenzene sulfonate (Na-salt) | 10.0 | 8.5 | 7.0 | — | 6.4 |
| $C_{15-17}$-n-alkane sulfonate " | — | — | — | 8.5 | — |
| $C_{12-14}$-alkyl diglycol ether sulfate (Na-salt) | 5.0 | 4.25 | 3.6 | 4.5 | 3.2 |
| $C_{12-18}$-soap (Na-salt) | 4.0 | 3.5 | 3.0 | 4.0 | 2.7 |
| $C_{16-18}$-alcohol + 10 EO | 10.0 | 8.5 | 7.0 | 10.0 | 6.4 |
| $C_{16-18}$-alcohol + 5 EO | 10.0 | 8.5 | 7.0 | 10.0 | 6.4 |
| $C_{14-15}$-oxoalcohol + 7 EO | 5.0 | 4.25 | — | — | 3.2 |
| $C_{12-14}$-alcohol + 6 EO | — | — | 3.5 | 5.0 | — |
| $C_{12-14}$-fatty acid diethanolamide | 5.0 | 4.25 | 3.5 | 4.0 | 3.2 |
| toluene sulfonate (K-salt) | 8.0 | 6.8 | 5.5 | 7.0 | 5.1 |
| ethanol | 5.0 | 4.25 | 3.5 | 4.5 | 3.2 |
| EDTA (Na-salt) | 0.5 | — | — | 0.5 | — |
| EDTA (triethanolamine salt) | — | 1.0 | 1.0 | — | 1.0 |
| formalin | 0.1 | 0.1 | 0.1 | 0.1 | 0.1 |
| optical brightener | — | 0.1 | 0.1 | — | — |
| perfume oil, dye | 0.4 | 0.4 | 0.4 | 0.4 | 0.5 |
| water | 37.0 | 45.6 | 54.9 | 41.5 | 58.6 |

The washing agent compositions of Table I were stored at temperatures between 0° C. and 40° C. for 9 weeks without any changes. An additional test series was alternately heated to +40° C. and cooled to −10° C. every day for 9 weeks; the solutions also remain unchanged upon return to room temperature. After two weeks of storage at −5° C., the products of Table I were viscous and after the same storage time at −10° C. they were pasty. A phase separation did not occur, and the original condition of the solution and its viscosity were restored upon rewarming.

The washing and foaming action of the compositions of Table I were determined in a commmercially available household washing machine with horizontal drum (model "Miele W 433"), using tap water with a hardness of 16° dH. The height of the foam could be observed through the viewing glass window in the front door of the washing machine. The free space between the foam level and the upper edge of the viewing window was divided into four zones with marks for the evaluation of the height of the foam; the following grades were given:

0=no foam
1=foam height ¼ of the viewing window
2=foam height ½ of the viewing window
3=foam height ¾ of the viewing window
4=foam at upper edge of viewing window
5=foam visible in the filling connection Small textile samples or small skeins of yarn soiled under standardized conditions (test materials and skeins of the Institute of Washing Research, Krefeld, of the Empa-Institute in St. Gallen, Switzerland, and of Test Fabrics, Inc., USA) were placed in the washing machine. Each time, 1 kg of moderately soiled household wash was added to produce actual conditions, i.e. to bring the load in the washer up to the normal level. The product according to Example 1 was used in a concentration of 2.6 gm per liter and that according to Example 5 in a concentration of 4 gm per liter. The amount of wash water was 25 liters, the ratio of textiles in kg to wash water in liter was 1:25, the wash temperature was 30 or 40° C., depending on the textiles, and the time of washing was approximately 15 minutes. The wash cycle was followed by 3 rinse cycles with tap water; the textile samples were then dried and the degree of whiteness was determined photometrically with filtered monochromatic light (460 nm). It should be mentioned that the standardized test soiling usually represents very intensive and resistant types of soiling that cannot be removed in one washing, even with the use of very effective substances and therefore provides a very good evaluation of the washing power.

Unsoiled textile strips were subjected to the same wash cycles 20 times in the presence of normally soiled household wash (1 kg for 20 gm test material or test skeins) and the degree of whiteness was determined photometrically to evaluate the secondary wash behavior, i.e. the increase in graying in the presence of soil. The results obtained are presented in Tables II and III. "A" means initial value.

A modern liquid detergent available on the market was used for comparison in the recommended concentration of 4 gm per liter. This liquid detergent is designated "V" in Tables II and III.

Every value given in the tables is the mean value of 5 parallel tests.

TABLE II

| | Temp. | % Remission | | | | | | |
|---|---|---|---|---|---|---|---|---|
| | | Soiled, 1 Washing | | | | Not soiled, 20 washings | | |
| | ° C. | 1 | 5 | V | A | 1 | 5 | V |
| Wool | 30° | 58.8 | 58.8 | 47.8 | 57.0 | 55.0 | 55.1 | 54.9 |
| Polyacrylonitrile | 40° | 47.5 | 47.6 | 41.8 | 84.9 | 84.0 | 84.1 | 82.7 |
| Polyamide | 40° | 65.7 | 65.7 | 54.8 | 85.1 | 85.0 | 84.7 | 84.0 |
| Polyester | 40° | 40.7 | 40.8 | 36.8 | 81.4 | 81.3 | 81.4 | 80.8 |
| Processed Cotton | 40° | 53.5 | 53.6 | 49.3 | 85.2 | 84.0 | 84.0 | 83.2 |
| Mixed Fabric of 65% Polyester and 35% Processed Cotton | 40° | 52.5 | 52.5 | 47.6 | 79.9 | 80.0 | 79.9 | 78.8 |

TABLE III

| | Foaming Grades | | |
|---|---|---|---|
| Temp. | 1 | 5 | V |
| 25° C. | 1.5 | 1.5 | 3 |
| 30° C. | 2 | 2 | 3.5 |
| 40° C. | 1 | 1 | 2 |

The above results in Tables II and III show the superiority of the products of the invention over a commercially available liquid detergent in both washing and foam inhibiting activity.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A low-foaming, liquid, aqueous washing agent concentrate consisting essentially of:

(a) from 5% to 12% by weight of a member selected from the group consisting of a linear sodium alkyl benzene sulfonate having from 10 to 13 carbon atoms in the alkyl chain, a linear secondary sodium alkane sulfonate having from 14 to 18 carbon atoms, and a mixture thereof;

(b) from 2% to 6% by weight of a linear sodium alkylpolyglycol ether sulfate having from 10 to 16 carbon atoms in the alkyl chain and from 1 to 3 ethylene glycol ether groups;

(c) from 2% to 6% by weight of a potassium or sodium soap composed of mainly saturated fatty acids having from 12 to 18 carbon atoms, of which 50% to 90% by weight have from 16 to 18 carbon atoms;

(d) from 15% to 28% by weight of a mixture of ethoxylated alcohols, composed of (i) from 30% to 50% by weight of linear primary ethoxylated alcohols having from 16 to 18 carbon atoms and 8 to 12 glycol ether groups and (ii) from 30% to 50% by weight of linear primary ethoxylated alcohols having from 16 to 18 carbon atoms and 3 to 7 glycol ether groups, both types of said ethoxylated alcohols having a ratio of saturated to monounsaturated hydrocarbon radicals of from 1:4 to 4:1, and (iii) from 10% to 30% by weight of a member selected from the group consisting of linear, primary, saturated ethoxylated alcohols, primary saturated ethoxylated alcohols having a methyl group in the 2-position, and mixtures thereof, said primary saturated ethoxylated alcohols having from 10 to 15 carbon atoms and from 4 to 9 glycol ether groups;

(e) from 2% to 7% by weight of a diethanolamide of fatty acids having from 10 to 16 carbon atoms in the fatty acid radial;

(f) from 4% to 10% by weight of a member selected from the group consisting of toluene sulfonate, xylene sulfonate and isopropylbenzene sulfonate in the form of the sodium, potassium or triethanolamine salt; and (g) from 2% to 7% by weight of an alkanol having from 1 to 3 carbon atoms;

and the remainder of said concentrate being water and optionally other conventional ingredients; with the proviso that (1) the total of all anhydrous components of said concentrate is from 40% to 65% by weight of said concentrate, (2) phosphates and salts of polymer carboxylic acids are absent, and (3) the content of alkanolamines is kept below 3% by weight.

2. The concentrate of claim 1 which contains from 6% to 10% by weight of component (a).

3. The concentrate of claim 2 wherein component (a) is sodium n-dodecyl-benzene sulfonate.

4. The concentrate of claim 1 which contains from 3% to 5% by weight of component (b).

5. The concentrate of claim 4 wherein component (b) is the sodium salt of the diglycol ether sulfate of alcohols from coconut oil.

6. The concentrate of claim 1 which contains from 3% to 5% by weight of component (c).

7. The concentrate of claim 6 wherein component (c) consists of sodium soaps of a mixture of coconut oil fatty acids and tallow fatty acids in a weight/weight ratio of 1:4 to 1:20.

8. The concentrate of claim 1 which contains from 16% to 25% by weight of component (d).

9. The concentrate of claim 8 wherein component (d) is a mixture of ethoxylated alcohols of the following composition:

(i) 35% to 45% by weight of linear, primary ethoxylated alcohols having an average of from 9 to 11 glycol ether groups, and (ii) 35% to 45% by weight of linear, primary ethoxylated alcohols having an average of from 4 to 6 glycol ether groups, wherein the alcohol radicals of said ethoxylated alcohols having from 16 to 18 carbon atoms consist of saturated and monounsaturated hydrocarbon radicals in a ratio of 1:2 to 2:1, and (iii) 15% to 25% by weight of a member selected from the group consisting of linear, primary, saturated ethoxylated alcohols, primary saturated ethoxylated alcohols having a methyl group in the 2-position, and mixtures thereof, said primary saturated ethoxylated alcohols having from 10 to 15 carbon atoms and having an average of 5 to 7 glycol ether groups.

10. The concentrate of claim 9 wherein the primary saturated ethoxylated alcohols of composition component (iii) have from 12 to 15 carbon atoms.

11. The cencentrate of claim 1 which contains from 3% to 6% by weight of component (e).

12. The concentrate of claim 11 wherein component (e) consists of fatty acid diethanolamides having from 12 to 14 carbon atoms in the fatty acid radical.

13. The concentrate of claim 1 which contains from 5% to 8% by weight of component (f).

14. The concentrate of claim 13 wherein component (f) is potassium toluene sulfonate.

15. The concentrate of claim 1 which contains from 3% to 6% by weight of component (g).

16. The concentrate of claim 15 wherein component (g) is ethanol.

17. The concentrate of claim 1 which contains from 0.1% to 2% by weight of at least one complexing agent selected from the group consisting of aminopolyphosphonic acids, aminopolycarboxylic acids, and mixtures thereof in the form of the sodium or potassium salt.

18. The concentrate of claim 17 which contains from 0.2% to 1% by weight of said complexing agent.

19. The concentrate of claim 18 wherein said complexing agent is the sodium salt of ethylenediamine tetraacetic acid.

20. The concentrate of claim 1 which contains from 0.001% to 0.5% by weight of a water-soluble optical brightener.

21. The concentrate of claim 1 wherein said other conventional ingredients optionally present are members selected from the group consisting of organic complexing agents, water-soluble optical brighteners, preservatives, dyes, perfumes, additives that impart a pearly luster and finishing agents.

* * * * *

UNITED STATES PATENT AND TRADEMARK OFFICE

CERTIFICATE OF CORRECTION

PATENT NO. : 4,153,570

DATED : May 8, 1979

INVENTOR(S) : Manfred Hennemann, Albrecht Löhr and Peter Krings

It is certified that error appears in the above-identified patent and that said Letters Patent are hereby corrected as shown below:

Column 5, line 62, "$R^4$ H" should read -- $R^4$ are H --.

Column 8, line 7, the ditto marks should read -- (Na-salt) --;

line 60, "25" should read -- 40 --;

line 61, "1:25" should read -- 1:40 --.

Column 9, line 6, "20" should read -- 30 --;

lines 21 - 22, the right-hand portion of the heading of Table II should read:

-- Not soiled, 30 washings --.
A 1 2 V

Signed and Sealed this

Fourth Day of March 1980

[SEAL]

Attest:

SIDNEY A. DIAMOND

Attesting Officer

Commissioner of Patents and Trademarks